US005169169A

United States Patent [19]

Crawford

[11] Patent Number: 5,169,169

[45] Date of Patent: Dec. 8, 1992

[54] SKI WAXING SYSTEM

[76] Inventor: Matthew B. Crawford, 8016 NE. 142nd St., Bothell, Wash. 98011

[21] Appl. No.: 652,577

[22] Filed: Feb. 7, 1991

[51] Int. Cl.[5] ..... A63C 11/08

[52] U.S. Cl. ..... 280/601; 208/809

[58] Field of Search ..... 280/601, 602, 600, 607, 280/609, 809, 604, 816, 11.18, 28, 842

[56] References Cited

U.S. PATENT DOCUMENTS

| | | | |
|---|---|---|---|
| 3,580,605 | 5/1971 | Spitler | 280/11.13 |
| 3,765,695 | 10/1973 | McGregor | 280/28 |
| 3,897,074 | 7/1975 | Titola | 280/11.13 |
| 4,036,320 | 7/1977 | Rabehl | 280/28 |
| 4,272,577 | 6/1981 | Lyng | 428/112 |
| 4,344,641 | 8/1982 | Lehn | 280/601 |
| 4,398,746 | 8/1983 | Heintz | 280/604 |
| 4,440,418 | 4/1984 | Stamfer | 280/604 |
| 4,647,061 | 3/1987 | Girard | 280/602 |
| 4,752,082 | 6/1988 | Sevington | 280/607 |
| 4,778,197 | 10/1988 | Floreani | 280/602 |
| 4,813,699 | 3/1989 | Burger et al. | 280/610 |

FOREIGN PATENT DOCUMENTS

| | | | |
|---|---|---|---|
| 0200046 | 10/1958 | Austria | 280/601 |
| 2246540 | 3/1973 | Fed. Rep. of Germany | 280/601 |
| 2602009 | 7/1977 | Fed. Rep. of Germany | 280/601 |
| 1416557 | 9/1965 | France | 280/601 |

*Primary Examiner*—David M. Mitchell

*Attorney, Agent, or Firm*—Trask, Britt & Rossa

[57] ABSTRACT

A ski waxing system (20) for applying a waxing substance (126) to the running surface (28) of a ski (22). In one embodiment, the waxing system (20) includes a wax supply canister (38) in fluid communication with supply terminals (44) on the top surface (26) of the ski (22). Capillaries (68) are formed in the body (24) of the ski to provide fluid communication between the supply terminal and the running surface (28). Nozzles (70) are formed in the running surface (28) to distribute the waxing surface to the running surface (28). A heel pump (40) is actuated by the skier's (30) boot heel (72) to urge the waxing substance through the system (20). Other alternative methods for practicing the invention are also disclosed.

4 Claims, 7 Drawing Sheets

SKI WAXING SYSTEM

TECHNICAL FIELD

The present invention pertains to snow skis, and, more particularly, to an on-board skier-controlled system for selectively applying a lubricating or waxing substance to the running surface of a snow ski when skiing.

BACKGROUND OF THE INVENTION

Snow skis typically consist of a pair of long, flat runners formed of word, metal, or plastic that curve upward in front and are attached to a boot for gliding or traveling over snow. Alpine and downhill skiers use their skis to glide down snow-covered slopes while cross-country skiers laterally traverse, climb, and slide down the slopes.

The speed at which a ski glides over the snow is determined by the friction between the base or running surface of the ski and the snow, the force with which the skier propels himself, and the slope of any hill the skier may be on. After a period of use, the running surface of the skis becomes scratched and rough, thereby increasing the friction between the snow and the ski. The increased friction reduces the gliding speed of the ski on a slope and increases the amount of effort required by the skier to push himself and the skis across the snow.

One method used by skiers for reducing the friction between the ski and the snow is to apply a waxing substance to the running surface of the ski. This waxing substance may be in a solid or liquid form. In most cases, the substance is a form of solid wax. This waxing media is generally applied by the skier to the running surface of the ski prior to use. One method for applying wax is to simply palm the wax into the base of the ski. The wax is rubbed into the ski with the palm of the hand using firm pressure to create high friction. The wax is then buffed with a brush, again using hard pressure.

However, with most hydrocarbon waxes, the most effective method of application is done with heat from an iron. The heat from the iron causes microstructural expansion of the running surface that enables greater absorption of the molten wax. With this method, one or more bars of hard wax are held against the hot iron so that the molten wax is dripped onto the ski. The iron is then applied to the molten wax to iron the wax into the ski. The wax on the ski is then scraped. Scraping done while the wax is liquid or warm tends to clean the ski base. Scraping after the wax has cooled to room temperature allows the wax to bond better for a more lasting effect. Special waxes such as those used for racing take extra time ironing to achieve maximum wax penetration. The result of this waxing method is a smooth thin layer of wax on the base of the ski.

A major drawback in making a single, time-consuming application of the waxing substance is that after gliding a short distance, the waxing substance is substantially removed from the running surface of the ski. Friction is then increased between the ski and the snow, requiring another application of the waxing substance. However, in cross-country skiing, it may be desirable to have as much friction as possible to improve traction. Thus, it is desirable to have a device that enables selective application of the waxing substance to the running surface of the ski to control the degree of friction. Consequently, there is a need for a user-controlled snow ski waxing system that enables lubrication when the ski is in use.

SUMMARY OF THE INVENTION

The present invention is directed to a system for selectively applying a waxing substance onto the running surface of a snow ski as the snow ski is moving the snow. Typically, snow skis have a base with a top surface and an opposing bottom or running surface. In its broadest form, the present invention comprises a container for storing a waxing substance, conduits for conducting the waxing substance to the running surface of the snow ski, and a device for controlling the release of the waxing substance from the container and its application to the running surface of the snow ski. This device could be a valve, solenoid switch, or pump.

In accordance with another aspect of the present invention, the container for storing the waxing substance is pressurized and the control device comprises a valve to allow a user to selectively release the pressurized waxing substance from the container. Preferably, the valve is motorized.

In accordance with another aspect of the present invention, the conduit comprises a passageway integrally formed within the internal structure or body of the snow ski that communicates with the top surface and the running surface of the ski, and a flexible conduit having one end connected to the passageway and the other end connected to the container to permit communication of the waxing substance in the container with the running surface of the snow ski.

In accordance with yet another aspect of the present invention, the container is pressurized and both the container and the conduit are integrally formed within the body of the snow ski. In this embodiment, the control device ideally comprises an electrically actuated valve formed in the conduit to permit selective application of the waxing substance, and a user-actuated switch, preferably mounted on a ski pole, to facilitate activation and deactivation of the valve.

In accordance with yet another aspect of the present invention, the control device comprises a manually operated pump, preferably of the plunger type, mounted on the top surface of the ski in alignment with the heel of the user such that as the heel of the user presses down on and lets up from the pump, a predetermined quantity of the waxing substance is applied to the running surface of the snow ski.

In accordance with yet another aspect of the present invention, an electric pump is mounted on or adjacent to the container and its operation is controlled by a user-actuated switch for pumping the waxing substance from the container to the running surface of the snow ski.

As will be readily appreciated from the foregoing description, the present invention enables the user of a snow ski to selectively apply a predetermined quantity of a waxing substance to the running surface of a snow ski as the snow ski is moving across the snow. As a result, the user can increase or decrease the friction between the snow and the ski, facilitating control of traction and speed. For instance, a cross country skier wishing to increase speed on a downhill slope will actuate the system to apply the waxing substance. On the other hand, if the cross country skier desires to reduce speed on a downhill slope or increase traction when climbing an uphill slope, the amount of waxing substance applied to the running surface of the snow ski can be reduced or eliminated. Furthermore, the system having the components mounted externally on the snow ski allows conventional snow skis to be converted to the present system, while an internal system having all components integrally formed within the body of the snow ski provides a less complicated and more streamlined approach. Users of the system formed in accordance with the present invention will have the advantage of being able to ski without stopping to reapply a waxing substance. In addition, this system can be used not only on Alpine and cross-country skis, but on skis used with vehicles such as aircraft. In this situation, a pilot can apply more waxing substance to decrease friction on take off and can decrease the amount of waxing substance or activate application of a braking substance through supplemental supply vessels to increase friction during landing. Consequently, the present invention will have many useful applications.

BRIEF DESCRIPTION OF THE DRAWINGS

The foregoing and other features and advantages of the present invention will be more readily appreciated as the same becomes better understood from the following detailed description of a preferred embodiment of the invention when considered in conjuction with the accompanying drawings, wherein.

DETAILED DESCRIPTION

Figure 1:
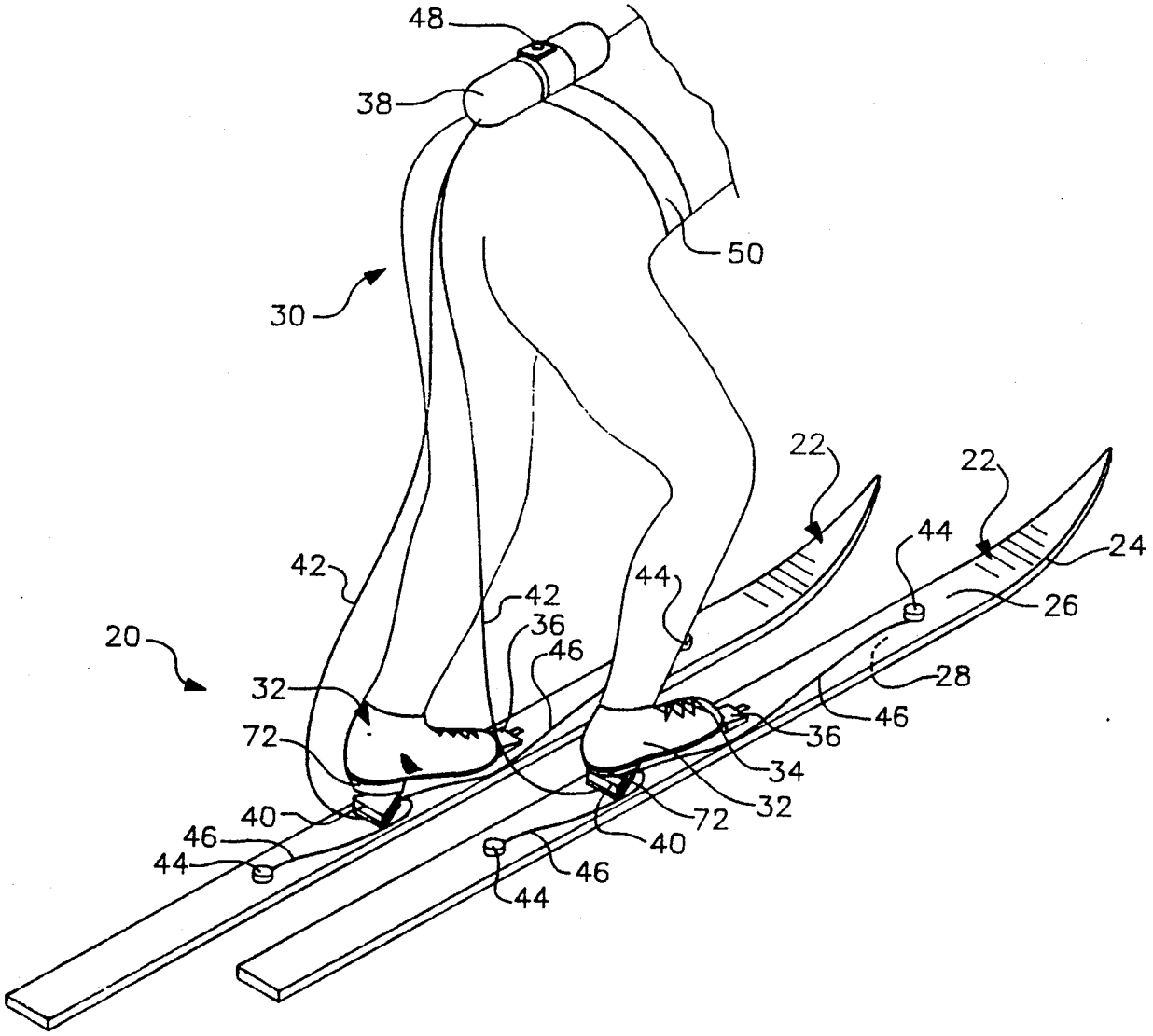
FIG. 1 is an isometric view of an external ski waxing system formed in accordance with the present invention as used on a cross country ski.
Figure 2:
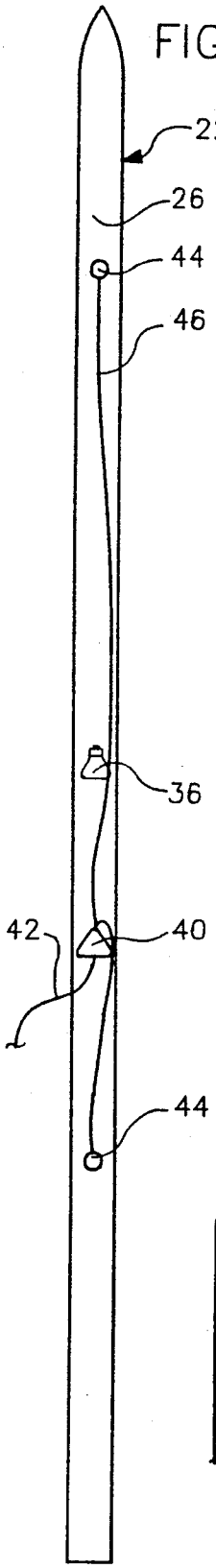
FIG. 2 is a top plan view of the external ski waxing system of FIG. 1.

Referring initially to FIG. 1, illustrated therein is an external ski waxing system 20 formed in accordance with the present invention as used on a pair of cross-country skies 22. Each ski 22 is formed of a runner or body 24 having a top surface 26 and a bottom or running surface 28. A skier 30 is partially illustrated having boots 32 with the toes 34 attached to toe bindings 36 on the top surface 26 of each ski 22. The skies 22, boots 32, and bindings 36 are readily commercially available and will not be described in detail herein.

The cross-country skies 22 illustrated in FIG. 1 have been modified to now include the external ski waxing system 20, which comprises a canister 38 for storing a waxing substance, a heel pump 40 in fluid communication with the canister 38 via a supply line 42, and supply terminals 44 positioned forward and rearward of the boot 32 and in fluid communication with the heel pump 40 via external supply lines 46.

The canister 38 is ideally formed of lightweight material and is filled with the waxing substance. The supply of the waxing substance to the supply lines 42 is controlled by a push-button on/off switch 48 located on the canister 38. The canister 38 can be worn by the skier 30 on a belt 50. It is to be understood, however, that other devices or methods may be used for storing and carrying the waxing substance without departing from the spirit and scope of the invention. As illustrated in FIG. 1, the canister 38 is not pressurized, and as such the supply of waxing substance is fed by gravity to the heel pump 40. Thus, it is important that the canister 38 be located above the heel pump 40 and the supply lines 42 be located above the heel pump 40 to provide uninterrupted flow of waxing material to the heel pump 40.

Figure 3:
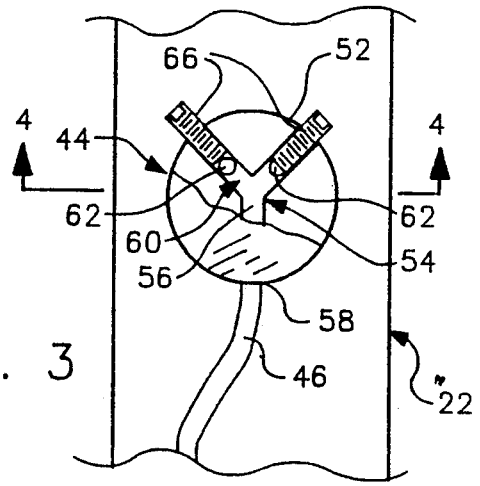
FIG. 3 is a top plan view of a supply terminal used in conjuction with the present invention of FIG. 1.
Figure 4:
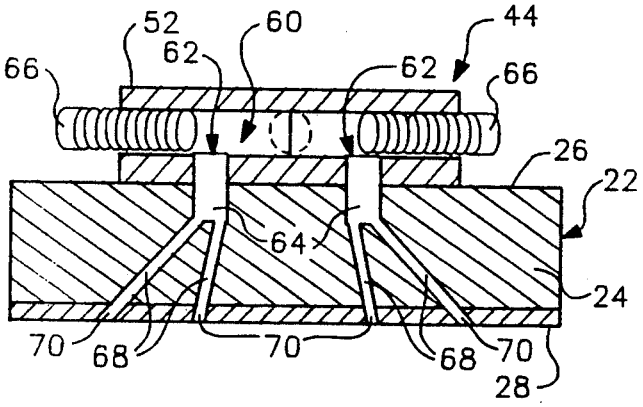
FIG. 4 is a cross sectional view taken along lines 4—4 of the supply terminal of FIG. 2.

A representative embodiment of a supply terminal 44 used in conjunction with the external ski waxing system 20 is illustrated in more detail in FIGS. 3 and 4. Referring initially to FIG. 3, the supply terminal 44 is shown as comprises a generally cylindrical housing 52 in which is formed a Y-shaped passageway 54 for conducting a waxing substance. The stem 56 of the Y-shaped passageway 54 is in fluid communication with the external supply line 46 via an inlet port 58. Each branch 60 of the Y-shaped passageway 54 has an exit port 62 formed therein that communicates with internal passageways 64 formed in the skies 22, as shown more clearly in FIG. 4. A threaded fastener 66 is threadably received within each of the branches 60 to permit adjustable restriction of the exit ports 62 to thereby enable the skier to control the amount of waxing substance applied to the running surface of the ski 22. The supply terminal housing 52 is attached to the top surface 26 of the snow ski 22, as illustrated in FIG. 4, with the exit ports 62 in fluid communication with the internal passageways 64 formed in the ski body 24. The internal passageways 64 branch off into a plurality of capillaries 68 that open to the running surface 28. More particularly, the capillaries 68 open to the exterior of the ski 22 through nozzles 70 formed in the running surface 28.

In this embodiment, the present invention is adapted to be fitted to existing skies. Thus, the capillaries 68 and nozzles 70 would most likely be drilled into the ski 22 and the supply terminal 44 would be mounted to the top surface 26 of the ski 22 by means of conventional fasteners or adhesives. Since the methods and devices for accomplishing this are known to those skilled in the art, they need not be described in detail herein.

In operation, the cross-country skier 30 attaches the boots 32 to the toe bindings 36. The canister 38, filled with a waxing substance, is attached to the skier's belt 50. As the skier 30 begins moving along a trail, the heel 72 of the skier's boots 32 repeatedly bears down on the heel pump 40, causing the waxing substance to be drawn to the supply lines 42 and forced into the supply terminals 44 through the external supply lines 46. The waxing substance is then distributed onto the running surface 28 of each ski 22 through the capillaries 68 and nozzles 70 that are in fluid communication with the supply terminals 44. The amount of waxing substance distributed to the running surface 28 of the ski 22 is controlled by turning the threaded fasteners 66 to cover or uncover the exit ports 62 inside the supply terminal 44. Typically this is done prior to the skier 30 starting out or when the skier 30 encounters changing snow conditions that require more or less waxing substance to be applied to the running surface 28 of the ski 22.

Figure 5:
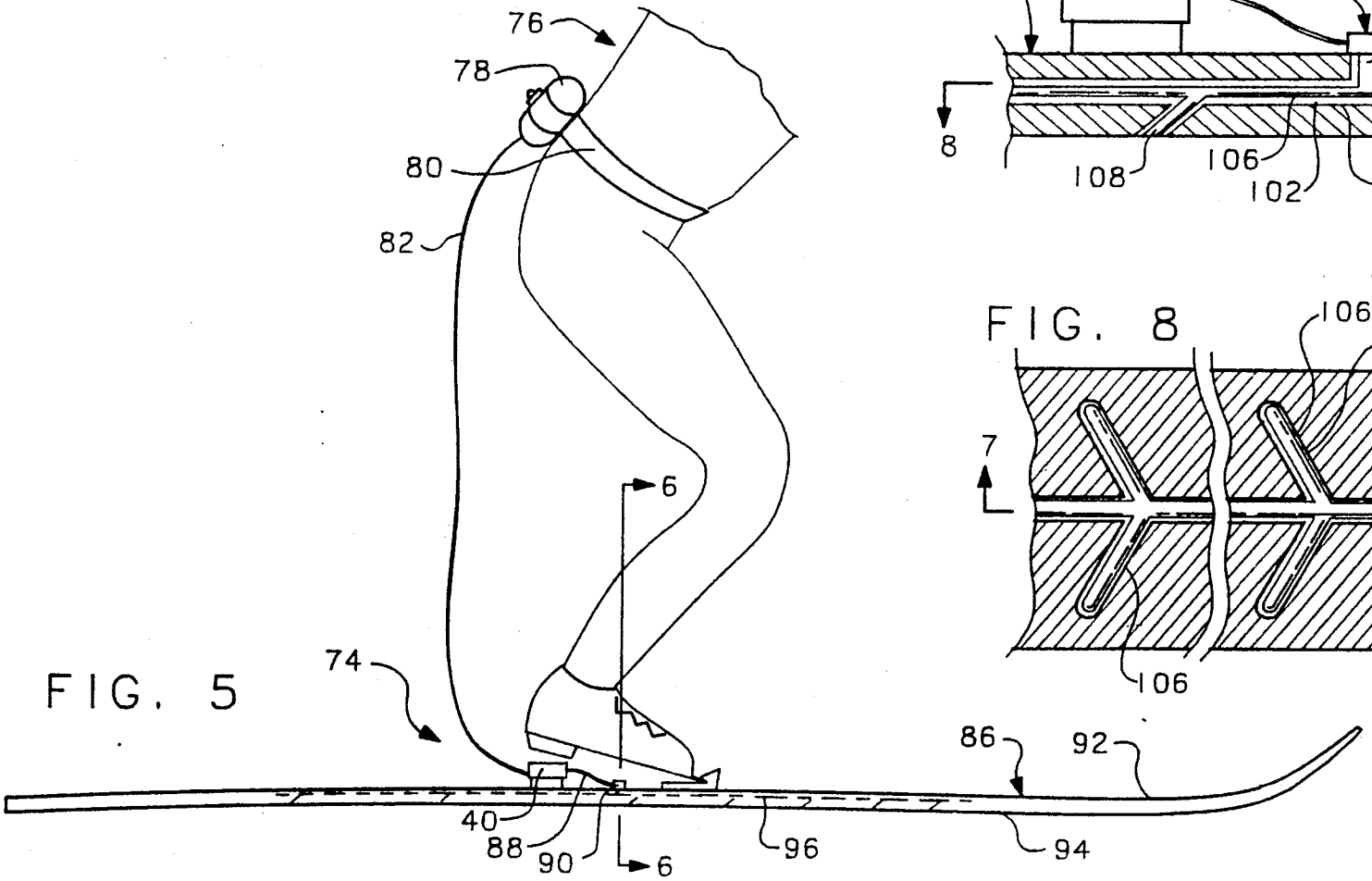
FIG. 5 is a side elevational view of a combination internal and external ski waxing system formed in accordance with the present invention as used on a cross country ski.

Turning now to FIG. 5, an alternative embodiment of the above-described ski waxing system is illustrated herein as a cross-country ski waxing system having an external wax bladder and an internal vein delivery system 74. In this system, the skier 76 utilizes an external storage canister 78 attached to the belt 80 as previously described. A supply line 82 is in fluid communication with the canister 78 and the heel pump 40 for each ski 86. The heel pump 40 is of the type described above in conjunction with FIGS. 3 and 4. A short external supply line 88 provides fluid communication with the heel pump 40 and a wax supply inlet port 90 formed on the top surface 92 of the ski 86. The waxing substance is supplied to the running surface 94 of the ski 86 via internal passageways 96 that will be described in more detail herein below.

Figure 6:
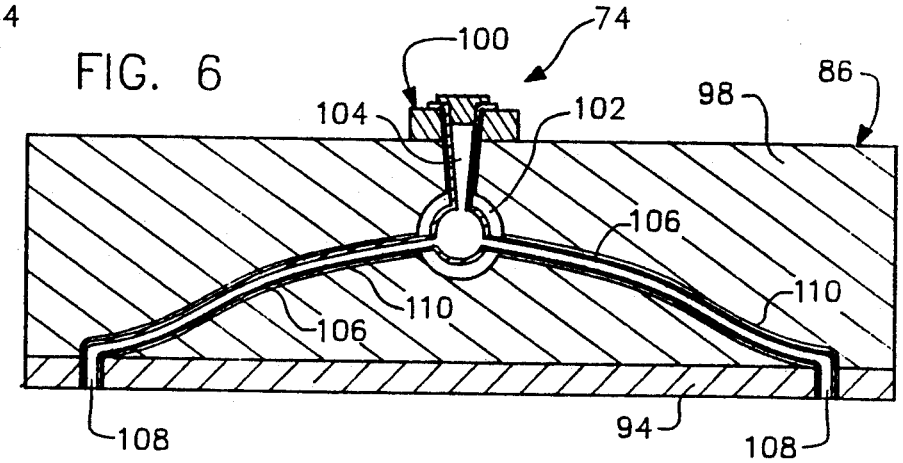
FIG. 6 is a cross sectional view taken along lines 6—6 illustrating the capillary conducting system for the waxing substance of the internal and external waxing system of FIG. 5.
Figure 7:
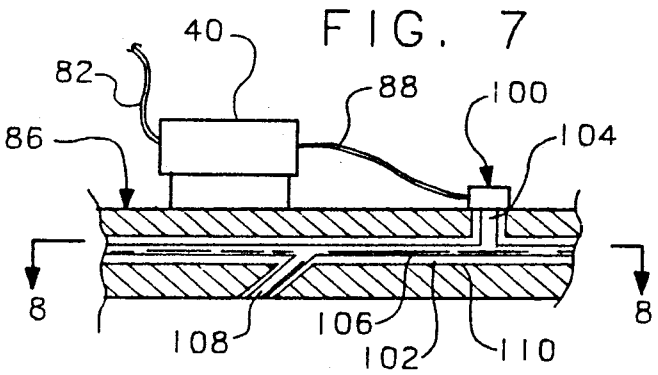
FIG. 7 is a partial cross-sectional view of the ski waxing system of FIG. 6 taken along lines 7—7 of FIG. 8.
Figure 8:
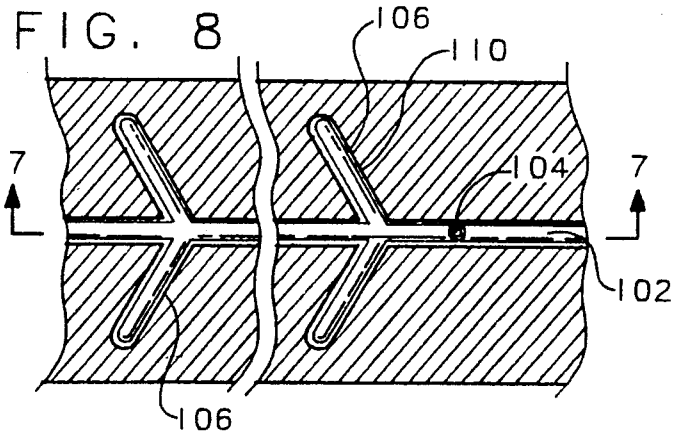
FIG. 8 is a side cross-sectional view taken along lines 8—8 of the ski waxing capillary system illustrated in FIG. 7.

FIGS. 6—8 illustrate the internal vein delivery system 74 from three different cross sectional views. Referring initially to FIG. 6, the inlet port 90 is shown formed in the top surface 92 of the ski body 98 and further having an inlet port plug 100. The inlet port plug 100 performs substantially the same function as a supply terminal 44, and can include a set screw adjustment for volume control.

The internal vein delivery system 74 further includes a longitudinal passageway 102 formed in the body 98 of the ski 86 that is in fluid communication with the inlet port plug 100 via an inlet port passageway 104 and further communicates with the running surface 94 of the ski 86 via lateral capillaries 106 and nozzles 108. Preferably the inlet port passageway 104 has a reducing diameter from the inlet port plug 100 to the longitudinal passageway 102 to equalize wax volume. Similarly, the longitudinal passageway 102 can be formed to have a reducing diameter towards the forward and rear portions of the ski 86. Ideally, the capillaries 106 are angled rearward (as shown in FIG. 8) and downward (as shown in FIG. 7).

The method for forming the various passageways inside the body 98 may vary according to the materials and methods used to manufacture the ski. As illustrated in FIGS. 6–8, the passageways include a vinyl trim 110 that lines the interior of the passageways which were formed during the construction of the ski body 98. However, this vinyl trim 110 is optional, and may not be necessary to forming the passageways. For instance, the passageways may be formed in the body 98 of the ski prior to installation of the running surface. After the running surface is installed, the nozzles 108 will have to be drilled to access the various capillaries 106. It is to be understood, however, that various methods may be used by those skilled in the art for forming the internal passageways without departing from the spirit and scope of the invention.

Figure 9:
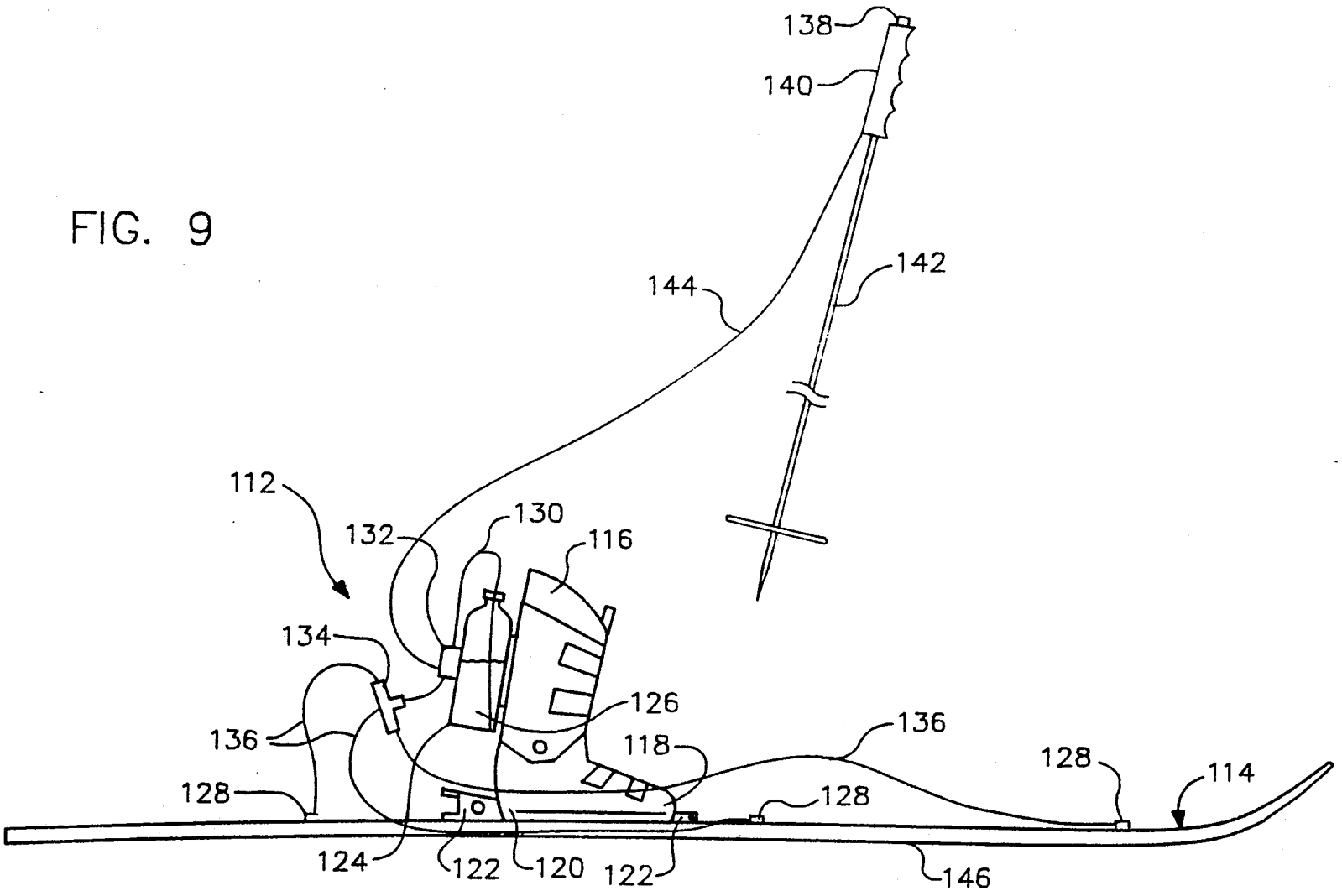
FIG. 9 is a side elevational view illustrating an external ski waxing system formed in accordance with the present invention as used in conjunction with an alpine or downhill ski.

FIG. 9 illustrates yet another embodiment of the present invention wherein an external supply delivery system 112 is illustrated in conjuction with a downhill ski 114. With the downhill ski 114, the boot 116 has both the toe 118 and heel 120 attached to bindings 122 to firmly hold the boot 116 to the ski 114. As illustrated in FIG. 9, a pressurized waxing substance canister 124 is shown attached to the boot 116. However, it is to be understood that the canister 124 can be attached to the ski 114 or the skier (not shown). In the preferred embodiment illustrated in FIG. 9, the canister is attached to the boot 116 instead of to the skier so the skier will not be injured and the canister will not be damaged should the skier fall. The waxing substance 126 inside the pressurized canister 124 is delivered to the supply terminals 128 on the ski 114 via a supply line 130 having one end inside the canister 124 and the other end in fluid communication with a solenoid 132. The solenoid 132 controls the release of the waxing substance to the supply terminals 128 through a manifold 134 and external supply lines 136. The operation of the solenoid 132 is controlled by a switch 138 mounted in the handle 140 of the ski pole 142. While the pole 142 is shown directly wired to the solenoid 132 via a cable 144, it is to be understood that radio frequency communication between the switch 138 and the solenoid 132 may also be used without departing from the spirit and scope of the invention. With this system, selective activation of the solenoid 132 and application of the waxing substance 126 to the running surface 146 of the ski 114 is easily controlled by the skier using the handle-mounted switch 138 on the pole 142. The supply terminals 128 are of the type described above in conjunction with FIGS. 3 and 4 and need not be described in detail herein.

Figure 10:
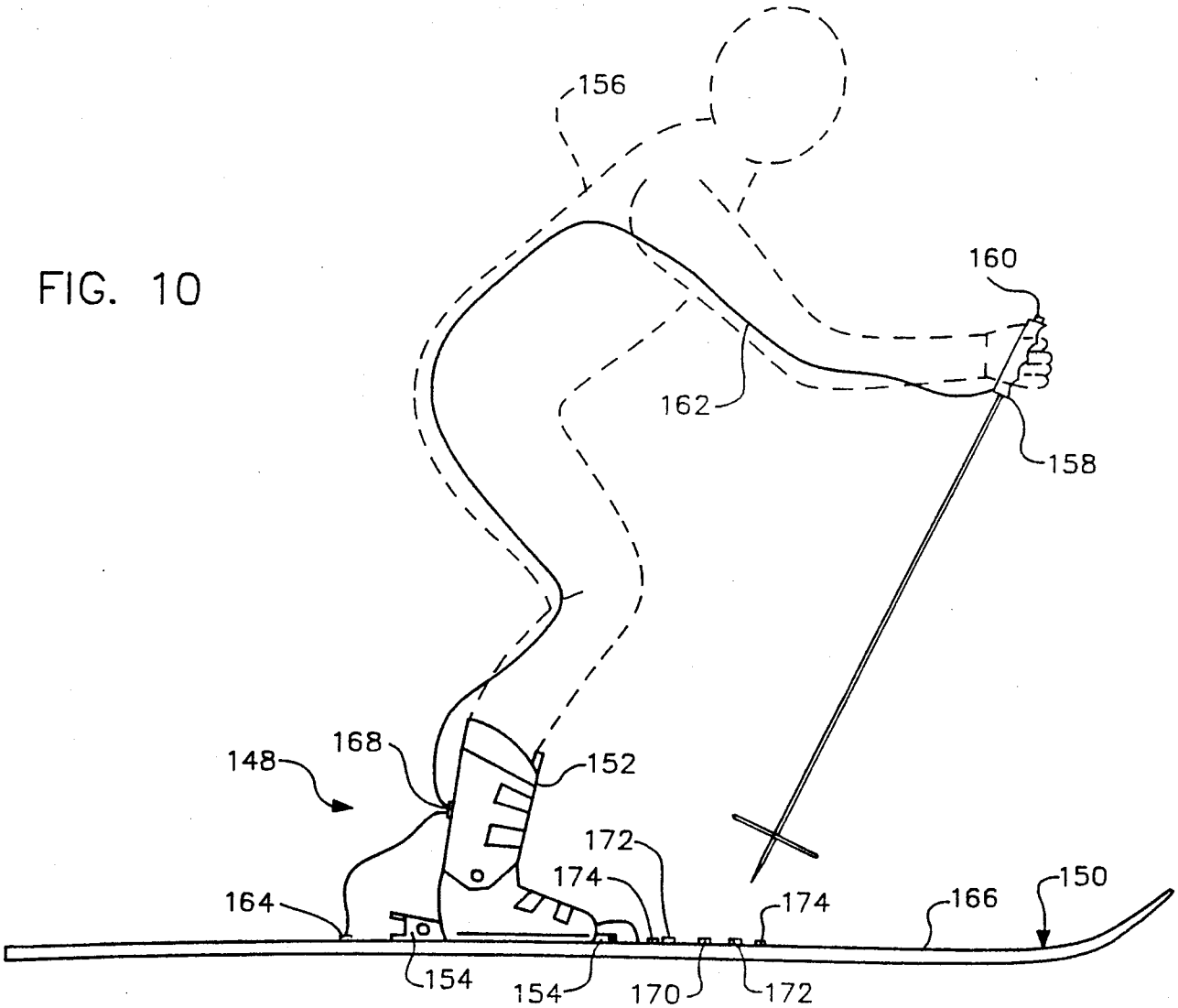
FIG. 10 is a side elevational view of an internal ski waxing system formed in accordance with the present invention as used on an alpine or downhill ski.

FIG. 10 illustrates a further alternative embodiment of the present invention wherein an internal supply system 148 is used in conjunction with a downhill ski 150. The ski 150 is of the type described above and includes a boot 152 attached to the ski 150 by toe and heel bindings 154. The skier 156 is shown in phantom for purposes of illustration only. In the overview of FIG. 10, it can be seen that the ski handle 158 contains a switch 160 that is hard wired via cable 162 to a terminal plug 164 on the top surface 166 of the ski 150. The cable 162 may be placed within the skier's clothing and then affixed to the boot 152 at a boot junction plug 168 as shown. However, the boot 152 can have integral prongs formed therein that can be received in a receptacle in the ski 150 to provide electrical contact. Other methods of providing an electrical connection may also be used.

Figure 11:
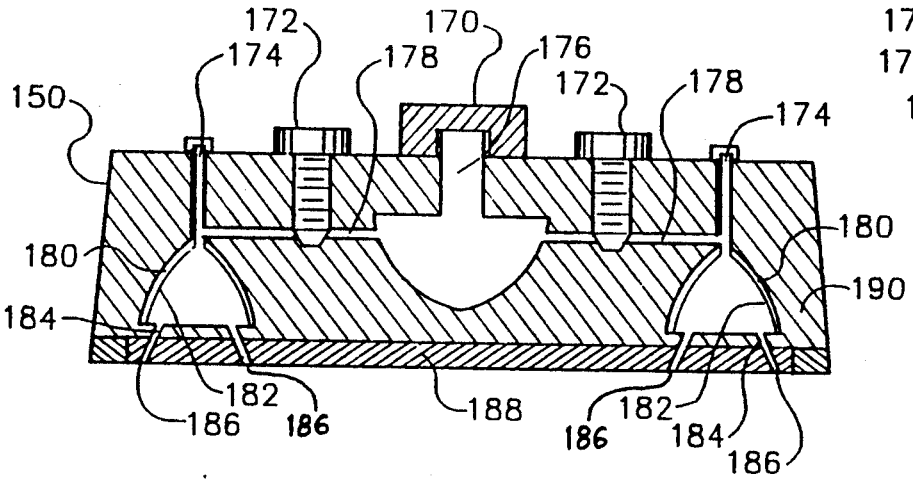
FIG. 11 is a cross sectional view taken along lines 11—11 of the internal ski waxing system illustrated in FIG. 12.

Forward of the ski bindings 154 is a pressure chamber charging port 170, a pair of solenoids 172 electrically connected to the terminal plug 164, and a pair of supply bladder fill ports 174. Turning to FIG. 11, the configuration of the internal supply system 148 is shown in greater detail. In the center thereof is a pressure chamber 176 that communicates via lateral passageways 178 with containment chambers 180 on both sides thereof.

Formed or contained within each containment chamber 180 is a flexible supply bladder 182 that communicates at the top with the fill ports 174 and at the bottom with the capillaries 184 and nozzles 186 formed in the running surface 188 of the ski body 190. Internal wiring (not shown) provides electrical connection between the solenoids 172 and the terminal plug 164 on the ski 150.

The pressure chamber 176 is pressurized through the charging port 170 with a gas, such as air. The gas is contained within the pressure chamber 176 by the solenoids 172 that block the lateral passageways 178. Waxing substance is placed inside the flexible supply bladders 182 through the fill ports 174. When it is desired to apply the waxing substance to the running surface 188 of the ski 150, the skier actuates the switch 160 to activate the solenoids and partially unblock the lateral passageways 178. The pressurized gas in the pressure chamber 178 then pressurizes to the containment chamber 180 to urge the waxing substance out of the supply bladders 182 and through the capillaries 184 and nozzles 186 to the running surface 188 of the ski 150.

Figure 12:
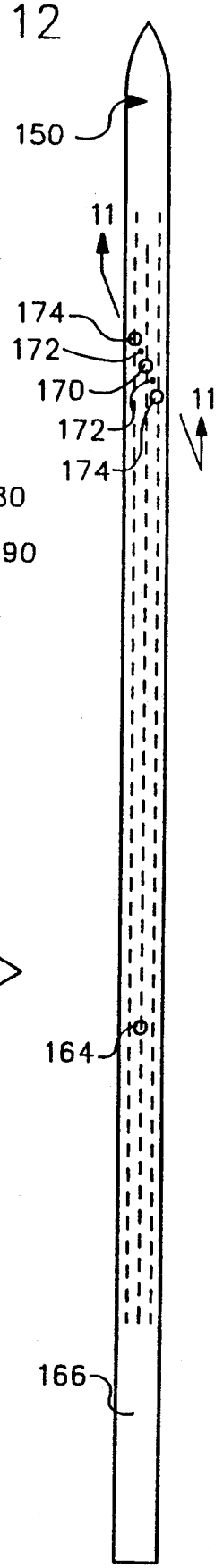
FIG. 12 is a top plan view of the internal ski waxing system of FIG. 10.

The plan view of FIG. 12 illustrates the relative positioning of the charging port 170 and fill ports 174 at the forward end of the ski 150 and the terminal plug 164 attached to the top surface 166 near the rearward end of the ski 150. Preferably, the openings for the charging port 170 and fill ports 174 are staggered longitudinally on the ski 150 to avoid weakening the ski 150 laterally. Similarly, the nozzles 186 formed on the bottom of the ski will also be staggered longitudinally to avoid laterally weakening the ski 150. In order to prevent accidental introduction of waxing substance into the charging port 170 or the introduction of pressurized gas into the fill ports 174, preferably the charging port 170 is of a different size than the fill ports 174. Alternatively, the ports may be fitted with a safety device to require the skier to match the correct fill nozzle with the port.

In use, the skier will first choose the appropriate type of waxing substance for ski conditions and charge the supply bladders 182 thorough the fill ports 174. The skier will then charge the pressure chamber 176 through the pressure chamber charging port 170 to its maximum charge rate, preferably in the range of 100 to 150 pounds per square inch. After the skier has placed his boots in the bindings, he will connect the hard wire control cable 162 to the ski terminal plug 164. The switch 160 in the handle 158 may contain a battery pack (not shown) for powering the solenoids 172. The skier 156 can test the internal supply system 148 on each ski 150 to make sure it is operating properly. This is accomplished with a simple squeeze of the switch 160 with each hand and by sliding the skies 150 back and forth to feel the appropriate reduction of friction on the snow.

Figure 13:
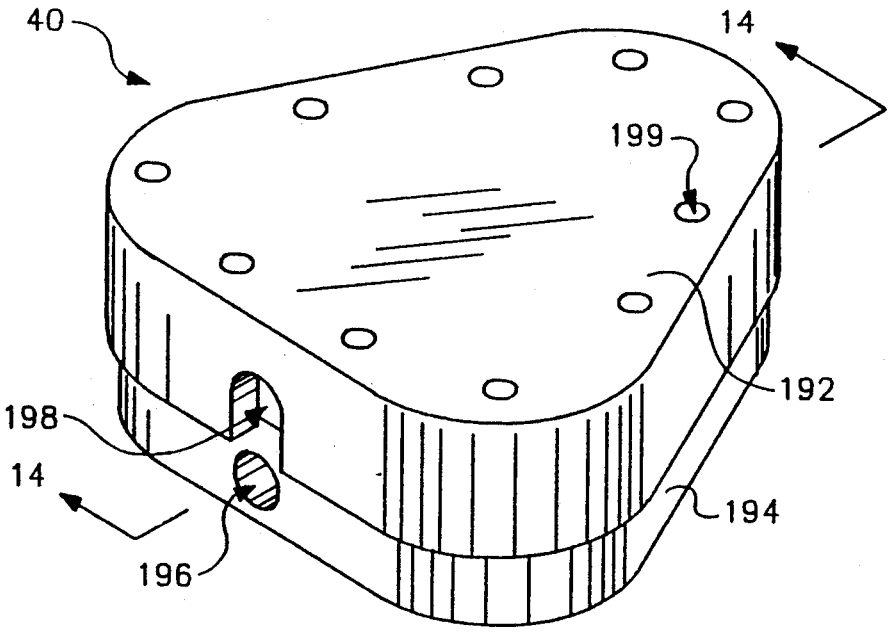
FIG. 13 is an isometric view of a heel pump formed in accordance with the present invention.
Figure 14:
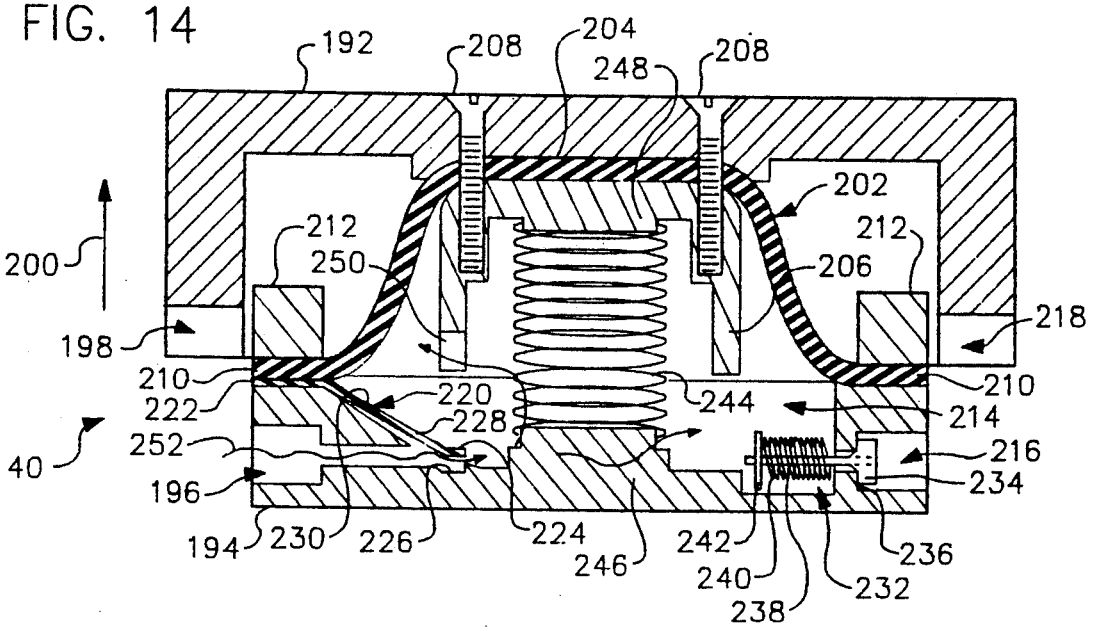
FIG. 14 is a side view in partial cross-section taken along lines 14—14 of the heel pump of FIG. 13.
Figure 15:
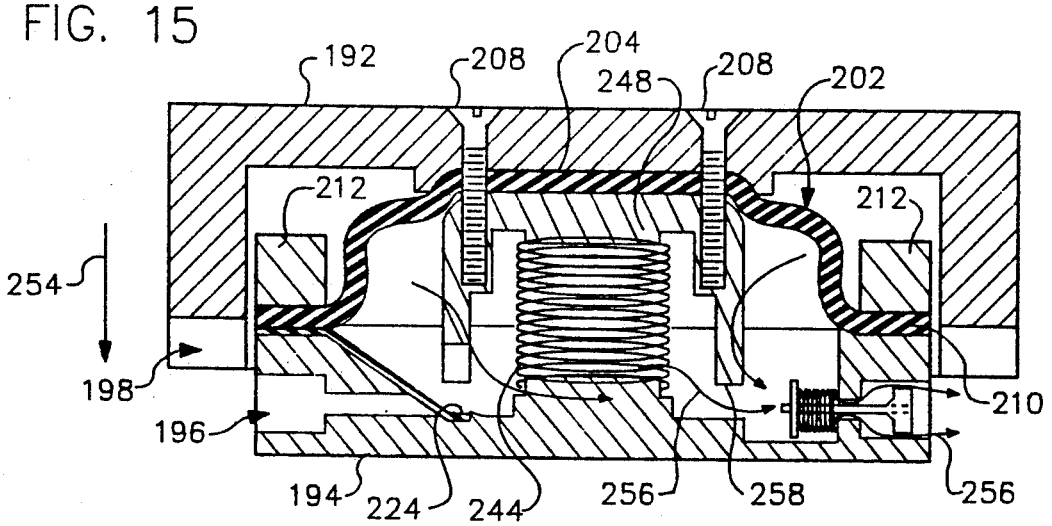
FIG. 15 is a side cross-sectional view of the heel pump of FIG. 13, showing partial compression of the heel pump.

FIGS. 13–15 illustrate in greater detail the heel pump 40 used with the external ski waxing system 20 and the internal vein delivery system 74 described in conjunction with FIGS. 1–8. FIG. 13 illustrates the exterior of the heel pump 40 having a heel impact plate 192 received over a base plate 194. An inlet port 196 is formed in the base plate 194 for the input of waxing substance. A cutout 198 is formed in the heel impact plate 192 in vertical alignment with the inlet port 196. The cutout 198 prevents the heel impact plate 192 from impacting an inlet line installed in the inlet port 196 when the heel impact place 192 is pressed downward by the skier's heel. A similar port and cutout are formed on the far side of the pump 40, as is shown in greater detail of the cross-sectional views of FIGS. 14 and 15. A plurality of opening 199 are formed in the impact plate 192 to allow access to fasteners.

Turning to FIG. 14, the heel pump 40 is shown with the impact plate 192 moving to the full upward position, as indicated by the arrow 200. Internally, the heel pump 40 includes a diaphragm 202 having a center portion 204 held in place between an impact cup 206 and the strike plate 192 with a plurality of fasteners 208. The peripheral edges 210 of the diaphragm 202 are held in place on the base plate 194 by a retaining ring 212. The retaining ring 212 is held to the base plate 194 with a plurality of fasteners (not shown). With the diaphragm 202 so installed, an interior chamber 214 is formed between the diaphragm 202 and the base plate 194. The interior chamber 214 communicates with the inlet port 196 and an outlet port 216 formed in the base plate 194. A cutout 218 is formed in the heel impact plate 192 in vertical alignment with the outlet port 216 to avoid contact between the heel impact plate 192 and a conduit or tubing attached to the outlet port 216.

The inlet port 196 includes a flapper valve 220 that closes off the inlet port when there is positive pressure in the interior chamber 214. The flapper valve 220 includes an upper flange 222, that is squeezed between the peripheral edge 210 of the diaphragm 202 and the base plate 194, and a lower flange 224 that is received within a recess 226 formed in the base plate 194. The body 228 of the flapper valve 220 angles downward from the upper flange 222 to the lower flange 224 and rests against a corresponding angled surface 230 formed in the base plate 194.

Similarly, the outlet port 216 includes a poppet valve 232 that is urged open under positive pressure from the interior chamber 214. The poppet valve 232 has a head 234 held against a valve seat 236 by a helical spring 238 received around a stem 240 of the poppet valve 232. The spring 238 is held on the stem 240 with a suitable retaining member 242. A helical spring 244 is mounted over a cylindrical projection 246 on the base plate 194 and over a similar cylindrical projection 248 formed on the inside surface of the impact cup 206. The impact cup 206 also includes a cutout 250 formed in vertical alignment over the flapper valve 220 to prevent interference with the flapper valve 220 when the impact cup is urged downward.

When the heel pump 40 has the heel impact plate 192 urged upward by the helical spring 244 as indicated in FIG. 14, a negative pressure is created in the interior chamber 214. With the negative pressure, the poppet valve 232 is urged closed by the helical spring 238, and the flapper valve 220 is urged open to uncover the inlet port 196. As a result, a waxing substance fed by the force of gravity from the supply canister is drawn into the interior chamber 214, as indicated by the arrow 252.

Referring next to FIG. 15, the heel impact plate 192 is shown being urged downward, as indicated by the arrow 254, which is caused by the skier's heel pushing downward on the heel impact plate 192. As the impact plate 192 moves downward, a positive pressure is created in the interior chamber 214 to close the flapper valve 220 and force the poppet valve 232 to open, providing fluid communication between the interior chamber 214 and the outlet port 216. As this occurs, the waxing substance contained in the interior chamber 214 is forced to flow through the outlet port 216, as indicated by the arrows 256. Downward motion of the heel impact plate 192 is limited by contact between the bottom surface 258 of the impact cup 206 and the base plate 194. In addition, downward travel of the heel impact plate 192 can also be limited by contact between the diaphragm retaining ring 212 and the heel impact plate 192.

While a preferred embodiment of the invention has been illustrated and described, it is to be understood that various changes can be made therein without departing from the spirit and scope of the invention. Thus, the invention is to be limited only by the scope of the appended claims.

The embodiments of the invention in which an exclusive property or privilege is claimed are as follows:

1. A system for selectively applying a waxing substance onto the running surface of a snow ski as the snow ski is moving across the snow, the snow ski having a body with a top surface and an opposing bottom or running surface, the system comprising:

means for storing the waxing substance said storing means being integrally formed within the body of the snow ski and is pressurized;

means for conducting the waxing substance from said storing means to the running surface of the snow ski said conducting means being integrally formed within the body of the snow ski; and means for controlling the movement of the waxing substance through said conducting means to the running surface of the snow ski said control means comprising an electrically actuated valve for controlling the release of the waxing substance from said storing means and a switch means for enabling a user to selectively activate and deactivate said valve.

2. The system of claim 1, wherein said control means comprises a valve that is user controlled to permit selective application of the waxing substance to the running surface of the snow ski.

3. A snow ski waxing system, comprising:

a snow ski formed of an elongated body having a top surface and an opposing bottom or running surface;

one or more storage chambers integrally formed within said body of said snow ski for storing a fluid waxing material, each of said storage chambers having a liquid waxing material inlet port, a pressurized gas inlet port, and one or more outlet ports;

one or more pressure chambers integrally formed within said body of said snow ski for storing a pressurized gas, each of said pressure chambers having an inlet port and one or more outlet ports, each of said outlet ports communicating with one of said one or more storage chambers via at least one passageway integrally formed within the body of said snow ski having one end in fluid communication with said outlet port of said pressure chamber and the other end in fluid communication with said pressure inlet port of said storage chamber;

valve means associated with said passageway for controlling the introduction of pressurized gas from said pressure chamber into said storage chamber to thereby control the flow of the fluid waxing material from said storage chamber to said running surface of said snow ski; and a remote switch means in electrical communication with said valve means to enable a user to selectively control said valve means to thereby control the flow of the fluid waxing material from said storage chamber to said running surface of said snow ski.

4. The system of claim 3, wherein each of said one or more storage chambers is lined with a flexible bladder having an opening therein in fluid communication with the fluid waxing material inlet port such that upon the introduction of pressurized gas to said storage chamber from said pressure chamber, said flexible bladder is compressed against the fluid waxing material stored within said storage chamber to thereby force the fluid waxing material from the storage chamber to said running surface of said running ski.

* * * * *